US006511302B1

(12) United States Patent
Dwyer

(10) Patent No.: US 6,511,302 B1
(45) Date of Patent: Jan. 28, 2003

(54) SLURRY PISTON PUMP WITH CYLINDER CLEANING APPARATUS

(75) Inventor: Bernard B. Dwyer, Cincinnati, OH (US)

(73) Assignee: Magnum Pumps, Inc., West Chester, OH (US)

( * ) Notice: Subject to any disclaimer, the term of this patent is extended or adjusted under 35 U.S.C. 154(b) by 0 days.

(21) Appl. No.: 09/898,798

(22) Filed: Jul. 5, 2001

(51) Int. Cl.[7] ..... F04B 17/00; F04B 35/04; F04B 15/02

(52) U.S. Cl. ..... 417/403; 417/401; 417/900; 417/53

(58) Field of Search ..... 417/401, 403, 417/900, 53

(56) References Cited

U.S. PATENT DOCUMENTS 2,330,781 A * 9/1943 Langmyhr et al. ..... 277/350
2,545,506 A * 3/1951 Walsh ..... 417/382
2,879,083 A * 3/1959 Corsette ..... 285/114
3,263,968 A * 8/1966 Sahlstrom ..... 366/194
3,647,325 A * 3/1972 Johnson ..... 417/454
3,704,967 A * 12/1972 Tarulli ..... 417/519
3,857,328 A * 12/1974 Taylor ..... 417/231
6,116,865 A 9/2000 Fischer et al. ..... 417/403

FOREIGN PATENT DOCUMENTS

JP 60-56186 * 4/1985 ..... F04B/15/02

* cited by examiner

*Primary Examiner*—Charles G. Freay
*Assistant Examiner*—Timothy P. Solak
(74) *Attorney, Agent, or Firm*—Wood Herron & Evans LLP

(57) ABSTRACT

A slurry piston pump (10) including a fluid hose (70) coupled into the back end (26) of a piston cylinder (24) to provide cleaning and/or lubricating fluid (60) into the interior (23) of cylinder (24) while allowing cylinder (24) to be directly coupled to a drive cylinder (12).

43 Claims, 2 Drawing Sheets

SLURRY PISTON PUMP WITH CYLINDER CLEANING APPARATUS

BACKGROUND OF THE INVENTION

I. Field of the Invention

The present invention relates to slurry piston pumps, and more particularly, to such pumps for pumping concrete and the like.

II. Description of Prior Art

Piston pumps are often utilized to pump thick slurry mixes (examples of which include concrete, cement, stucco, mortar, gypsum, sludge, silt, mud and topsoil, and bentonite) for construction and remediation purposes. By way of example, a concrete pumping truck may include a swing tube which swings back and forth within a concrete hopper mounted at the back end of the truck. A piston pump, or a pair of piston pumps in a dual pump, communicate with the concrete hopper and swing tube.

Each piston pump includes a drive cylinder which has a drive rod extending therefrom, with a piston mounted to the exposed end of the drive rod. The piston extends into a piston cylinder, the back end of which is axially aligned with the drive cylinder, and the front end of which communicates into the hopper or with the swing tube, depending on the position of the swing tube. As a consequence, as the drive rod reciprocates within the drive cylinder, the piston is caused to move between the back and front ends of the piston housing. In the back stroke (during which the piston moves in a direction away from the front end and towards the back end), the front end of the piston cylinder opens into the hopper to pump concrete into the piston housing through the front end thereof. In the forward stroke (during which the piston moves in a direction away from the back end and towards the front end), the front end of the piston cylinder is advantageously coupled to the swing tube so as to pump the concrete from within the piston cylinder out through the swing tube, to a delivery hose coupled to the end of the swing tube so as to pump the concrete to the construction or remediation site.

Where a pair of such piston pumps are employed, the drive rods will typically reciprocate in opposite directions such that one pump is in the back stroke while the other is in the forward stroke. The swing tube shifts back and forth between the front ends of the two piston pump cylinders so as to couple to one of the piston pumps in the forward stroke for pumping of concrete from that piston cylinder, while the second piston pump communicates into the hopper to pump concrete into the piston cylinder of the second pump.

In conventional slurry piston pumps, whether a one piston pump or a dual piston pump, the nature of the slurry material involved creates a significant amount of debris and buildup which can interfere with the proper operation of the piston pump. As a consequence, it has been conventional practice to provide a so-called water box between the drive cylinder and the piston cylinder. The drive cylinder is typically attached to one side of the water box with the piston cylinder being attached to the opposite side of the water box. The result is to axially align the cylinder with a fluid receiving space therebetween defined by the water box. Thus, the drive rod extends from the drive cylinder, through the water box, and into the pump cylinder. As the drive rod traverses through the water box, it is cleaned or lubricated by the fluid in the water box. Additionally, the fluid in the water box is carried into and out of the piston cylinder behind the piston as it moves therein so as to clean or lubricate the interior wall of the piston cylinder as well.

Use of the water box, however, presents certain drawbacks. In the first instance, the length of the drive rod must be sufficient not only to properly move the piston through the piston cylinder between the ends thereof, but must also take into account the length of the fluid receiving space introduced between the drive cylinder and the piston cylinder by virtue of the water box interposed therebetween. Thus, the drive rod (and its associated cylinder) must be made sufficiently long to traverse the water box and to move the piston within its cylinder. Shorter drive rods (and associated cylinders) are, however, desired.

Additionally, the respective cylinders are coupled to the water box by bolts and nuts and the like, some parts of which are accessible only through the interior of the water box. A typical water box may be accessible through an opening in the top. Liquid may be added through that opening. Access to the interior of the water box in order to reach the components attaching the cylinder housings thereto for maintenance and repair is also by that top opening. However, the area over the top of the water box can be difficult to access. In many situations, the piston pumps form part of a larger pumping system, such as a concrete pumping truck. The piston pumps are usually situated in very tight quarters with respect to the rest of the pumping system making access to the water box, and especially the interior thereof, very difficult.

The water box my also have a lid over the top opening. Often, the lid does not stay in place. As a consequence, the liquid in the water box, as well as any debris from the slurry material, may slosh out of the water box creating a spill hazard, especially during use or movement of the pump system with its attendant jostling and the like.

SUMMARY OF THE INVENTION

The present invention provides a slurry piston pump which eliminates the water box and its attendant drawbacks. To this end, and in accordance with the principles of the present invention, a fluid hose is coupled into the back end of the piston cylinder through the cylinder wall and is situated radially outwardly therefrom so as to provide a reservoir for the cleaning or lubricating fluid. The fluid hose has a proximal or cylinder end coupled, such as through a fitting, to communicate directly into the back end of the pump cylinder through the cylinder sidewall, rather than from axially behind the cylinder as in the case of a water box. The fluid hose is thus coupled to expose the drive rod and the back side of the piston to the fluid as the drive rod reciprocates the piston through the piston cylinder, but without the need for a water box between the drive and piston cylinders and the disadvantages that would present. Instead, the drive cylinder may be coupled directly to the piston cylinder thereby shortening the length of the drive rod (and its associated cylinder). Additionally, the fluid hose may be flexible, and/or coupled to the piston cylinder by a fitting that is rotatably mounted to the piston cylinder sidewall, so that the fluid hose may be routed comfortably within tight quarters, but otherwise accessible as necessary. The hose may have a distal end fluidically remote from the cylinder end and through which fluid may be introduced into, or removed from, the hose. Access to the distal end is accomplished simply by manipulating the hose or rotating it about the coupling.

Where the piston pump has its own fluid hose, the distal end thereof may have a removable cap so as to selectively seal the fluid hose and the related piston cylinder. As a result, the fluid and any debris is kept from splashing out and creating a hazard while the piston pump is in use or being transported. If the hose is held in an upward vertical orientation, the cap may be vented so as to allow fluid to enter and leave the fluid hose from or to the piston cylinder without expelling out of the fluid hose or building up pressure therein. Alternatively, an expandable chamber or reservoir may be included in the hose or cap to accommodate pressure changes in the hose.

The above may be applied to individual slurry piston pumps whether a single, dual or other multiple pump piston system is employed. However, where a dual pump system is employed, it may be advantageous to couple together the fluid hoses associated with each piston cylinder. To this end, a fluid hose may extend between the back ends of the two piston cylinders so as to fluidically couple them through the same hose thereby exposing both drive rods and piston cylinders to the fluid in the hose. The hose in the dual piston pump system may be comprised of two separate hoses, referred to in that case as hose sections, each with a cylinder end coupled to the respective piston cylinders. A further fitting may be provided to selectively couple the distal ends of the hose sections together into, effectively, a single fluid hose. The flexibility of the hose and/or the rotatable fittings at the piston cylinders allows the hose to be situated in tight quarters, yet access thereto is easily gained. To fill the hose with liquid, or remove liquid therefrom, the further fitting joining the sections together may be unclamped or otherwise opened to thereby gain access to the distal end(s) of the hose section(s).

By virtue of the foregoing, there is thus provided a slurry piston pump which eliminates the water box and its attendant drawbacks.

BRIEF DESCRIPTION OF THE DRAWINGS

The accompanying drawings, which are incorporated in and constitute a part of this specification, illustrate embodiments of the invention and, together with the general description of the invention given above and the detailed description of the embodiments given below, serve to explain the principles of the present invention.

DETAILED DESCRIPTION OF THE DRAWINGS

Figure 1:
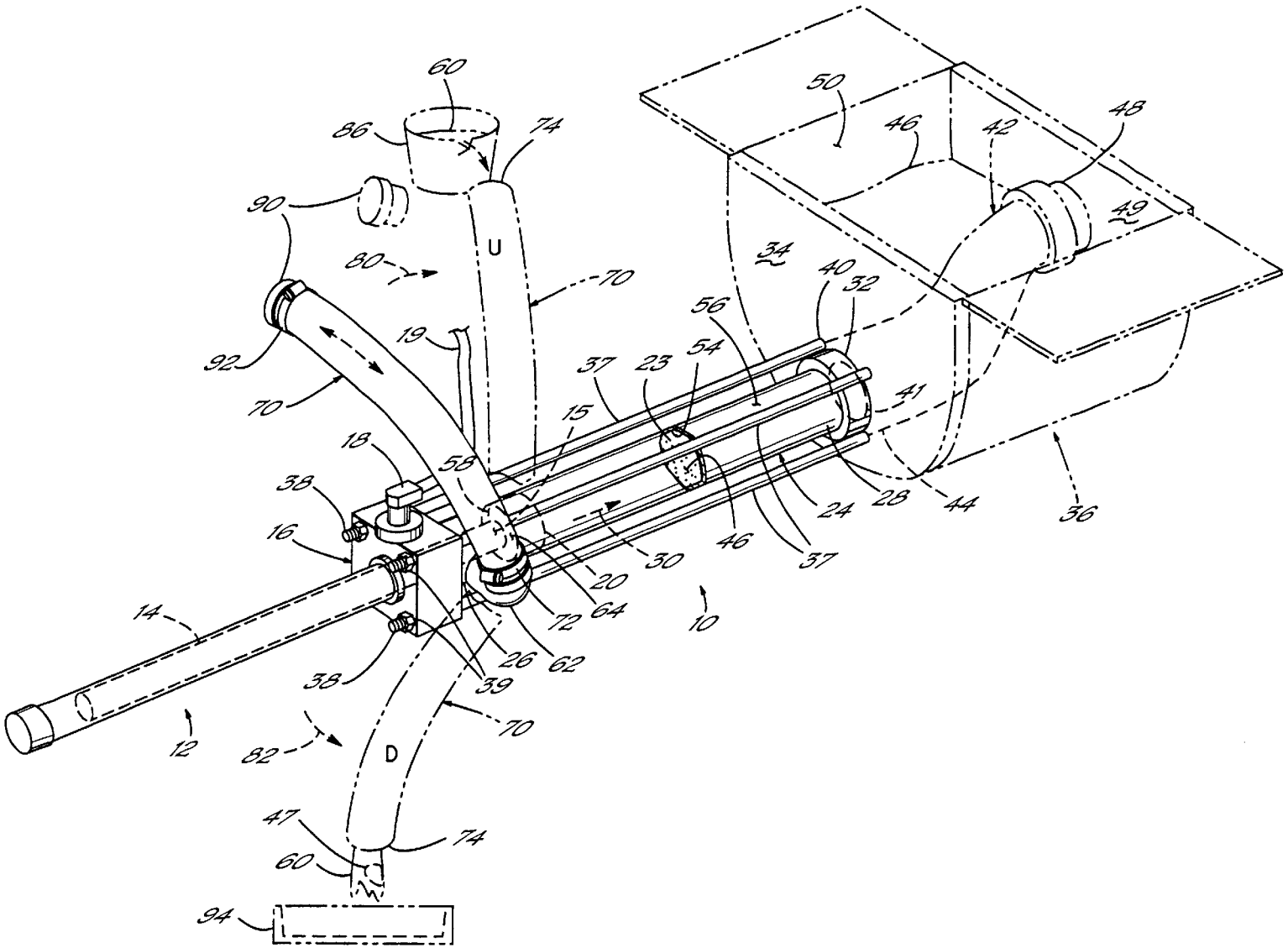
FIG. 1 is a perspective view, partially broken away, of a single slurry piston pump having a fluid hose in accordance with the principles of the present invention.

With reference to FIG. 1, there is shown a single slurry piston pump 10 for purposes of explaining the principles of the present invention. Piston pump 10 includes a drive cylinder 12 having a drive rod 14 reciprocally mounted therein. Drive rod 14 has an end 15 extending out from cylinder block 16 of drive cylinder 12 and is caused to move into or out of cylinder 12 under hydraulic pressure coupled into cylinder 12 through hydraulic connecter 18 on block 16. To this end, connector 18 is coupled through a hydraulic hose 19 to a source of controlled hydraulic or air pressure (not shown). Piston pump 10 further includes a piston 20 mounted to the exposed end 15 of drive rod 14. Piston 20 is fitted within the interior 23 of a piston cylinder 24 so as to be moveable between a back end 26 of cylinder 24 and a front end 28 thereof as drive rod 14 reciprocates. More specifically, in a forward stroke of piston 10, the piston 20 moves in a direction away from back end 26 and towards front end 28 as indicated by arrow 30. In a back stroke of piston 20, the piston 20 moves in a direction opposite to that of arrow 30 and thus moves in a direction away from front end 28 and towards back end 26.

Piston cylinder 24 is coupled at its back end 26 directly to cylinder block 16 of drive cylinder 12 so as to axially align cylinder 24 and 12, but without an intervening water box (not shown). The front end 28 of piston cylinder 24 is open to receive or expel slurry material. To this end, front end 28 of pump 10 is mounted to a support collar 32 which is on rear wall 34 of a concrete hopper 36 (shown in phantom lines in FIG. 1). A plurality of elongated tie rods 37 (only three are shown although four are present in the pump 10 of FIG. 1) are secured at threaded ends 38 to cylinder block 16 such as by nuts 39, and the other ends 40 are similarly secured to wall 34 of hopper 36 to constrain cylinder 24 therebetween. As a result, piston cylinder 24 is thus held directly to cylinder block 16 at back end 26 and to collar 32 and wall 34 at front end 28. Wall 34 includes an aperture 41 concentric with collar 32 so as to allow front end 28 of drive cylinder 24 to open into hopper 36 through wall 34.

Situated within hopper 36 is a swing tube 42 which is shown in FIG. 1 in a first position with its inlet end 44 confronting and communicating through aperture 41 with front end 28 of piston cylinder 24 so as to pump slurry material 46 within cylinder 24 into swing tube 42 via front wall 49 during the forward stroke of piston 20, such that the material 46 is forced out from the discharge end 48 of swing tube 42 via front wall 49 to a delivery hose (not shown) attached thereto. Swing tube 42 is moveable to and from a second position in which its inlet end 44 is moved out of alignment with piston cylinder 24 so as to expose front end 28 thereof into the interior 50 of hopper 36. In that state, as piston 20 is driven through its back stroke, slurry material 46 in hopper 36 will be pumped into cylinder 24 for pumping out through swing tube 42 during the next forward stroke of piston 20 when swing tube 42 moves back to the first position shown in FIG. 1. Although the swing tube 42 and hopper 36 are described herein, it will be understood that other slurry supply and delivery mechanisms could be employed. The swing tube and hopper are thus not directly part of the piston pump 10 and are instead shown merely by way of example, and not limitation.

It will be appreciated that as piston 20 moves through its strokes within piston cylinder 24, debris 47 from slurry material 46 may accumulate therein. The debris may foul the interior surface 54 of the sidewall 56 defining the interior 23 of cylinder 24, and/or may also foul drive rod 14. To reduce or eliminate that fouling, it is desirable to expose the drive rod 14 and the back end 58 of piston 20 (and thus those aspects of surface 54 therebehind) to a cleaning or lubricating fluid 60 such as water (where freezing is not an issue), or hydraulic or oil fluid. To this end, a fluid fitting such as an elbow 62 is mounted to the sidewall 56 of piston cylinder 24 adjacent, and advantageously just ahead of, back end 26 thereof so as to provide fluidic access into the interior 23 of piston cylinder 24 through cylinder wall 56. The proximal or cylinder end 64 of a fluid hose 70 is placed onto fitting 62 and clamped in place, for example, by a hose clamp 72, such that hose 70 is situated radially outwardly of cylinder 24 rather than between cylinders 12 and 24. Fluid 60 is placed into fluid hose 70 through the distal end 74 thereof.

Hose 70 may be comprised of flexible material such as polyurethane or PUC, and/or fitting 62 may be rotatably mounted to wall 56 at back end 26 of piston cylinder 24, so as to allow hose 70 to be placed into an upright position (as at U) as indicated by arrow 80 in FIG. 1, or to be moved into a downward position (as at D) as indicated by arrow 82. In the upright position as at U, the distal end 74 of hose 70 may be accessed so as to allow fluid 60 to be poured into hose 70 such as from a container 86. A cap 90 may be securely fitted against distal end 74 and held in place such as with a hose clamp 92 so as to seal hose 70 and prevent fluid 60 from leaking out of hose 70 and/or piston cylinder 24 in use. To empty the fluid 60 therefrom as well as any debris 47 from material 46, with hose 70 in the downward position as at D and cap 90 removed from end 74, fluid 60 and debris 47 will flow out of hose end 74 to be retrieved such as in a basin 94 positioned therebelow.

Hose 70, if of a flexible material, may be of any material suitable for use with fluid 60 under pressure. Hose 70 may advantageously be formed from clear material reinforced with wire braiding (not shown) for structural rigidity. The clear hose 70 has the advantage that the fluid 60 may be monitored for build up of debris 47 to know when to change fluid 60. One such hose is K7130 Polywire™ wire reinforced Kuri Tee® hose with heavy wall available from Kuriyama of America, Inc. An eighteen inch length of hose 70 may be used having a 1 ¼" or 1 ½" diameter, for example, although other lengths and diameters may be employed as desired.

Although cap 90 is shown as secured to end 74 by a clamp 92, it will be appreciated that end 74 could alternatively be provided with a threaded fitting (not shown) by which to threadably and removably receive a threaded cap (not shown) thereon. Also cap 90 may normally seal hose 70. However, where hose 70 is held, in use, in the upward position as at U, cap 90 may instead be vented (not shown) so as to allow fluid 60 to flow back and forth between hose 70 and cylinder 24 without pressure build-up problems. Alternatively, cap 90 may seal end 74 of hose 70, and an expandable reservoir (not shown) may be coupled to hose 70, such as between end 74 and cap 90, or built into cap 90, to accommodate pressure variation within hose 70.

In use of piston pump 10, swing tube 42 will be placed out of alignment with piston cylinder 24 during a back stroke of piston 20 so as to pump concrete 46 from hopper 36 into cylinder 24 through front end 28. On that back stroke, fluid 60 within the interior 23 of cylinder 24 behind piston 20 will be forced out of cylinder 24 and into fluid hose 70. On the forward stroke of piston 20, swing tube 42 will be aligned with front end 28 of cylinder 24 so as to pump concrete material 46 or the like out of cylinder 24 through swing tube 42. Also, on the forward stroke of piston 20, drive rod 14 will project into cylinder 24 to be cleaned and/or lubricated by fluid 60 from hose 70. Fluid 60 will also fill into cylinder 24 behind piston 20 from hose 70 so as to clean and/or lubricate the interior surface 54 of piston cylinder wall 56. The above thus provides the function of a water box but without the disadvantages thereof.

Figures 2, 3:
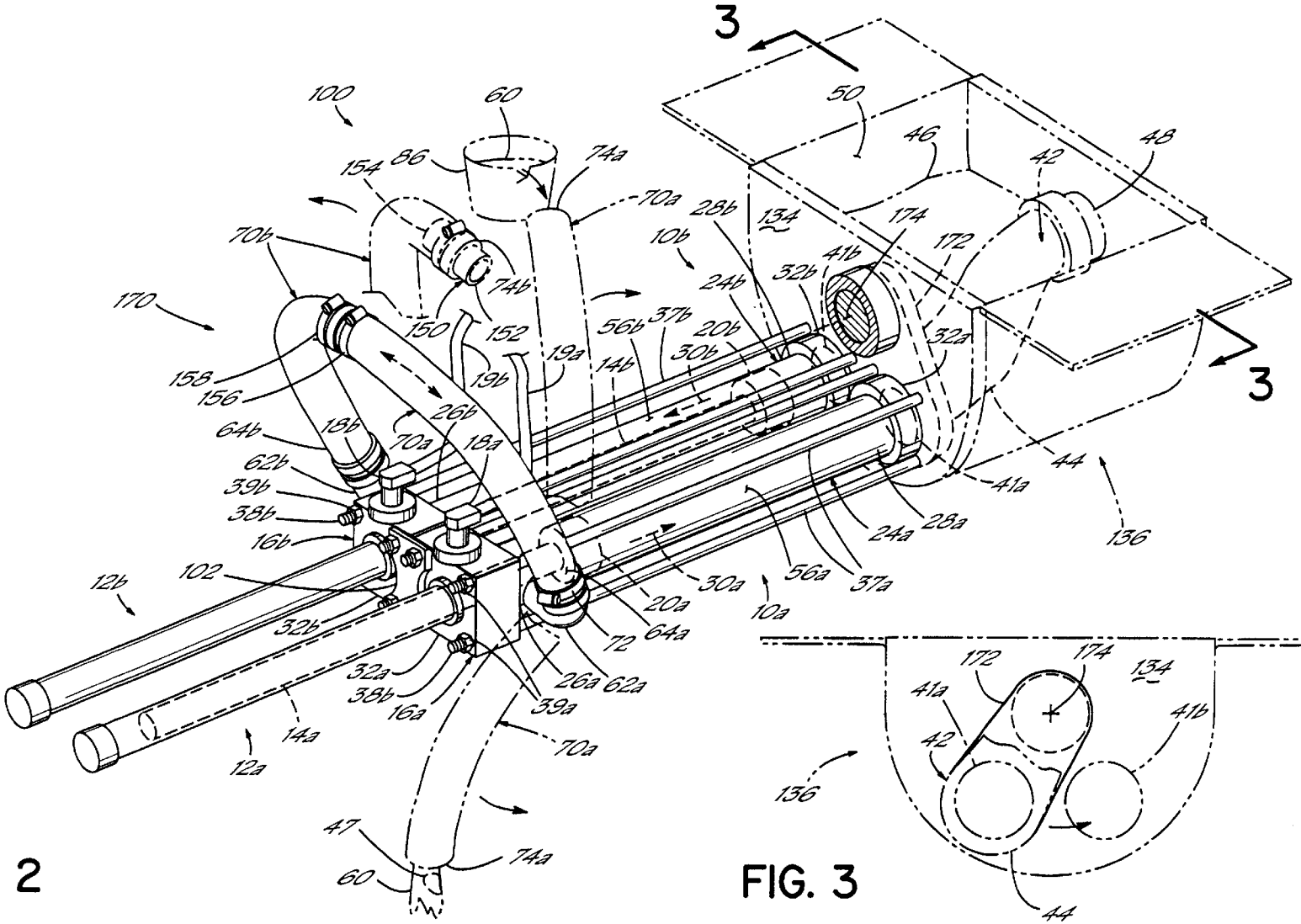
FIG. 2 is a perspective view of a dual slurry piston pump utilizing two of the piston pumps of FIG. 1 and having joined fluid hose sections in accordance with the principles of the present invention.
FIG. 3 is an end view taken along lines 3—3 of FIG. 2.

With reference to FIG. 2, a dual piston pump 100 is shown. Dual piston pump 100 includes two essentially identical piston pumps 10 as shown in FIG. 1, with identical reference numbers as in FIG. 1 with the additional designation a or b to distinguish between the two. Pumps 10*a* and 10*b* operate together to provide pumping action of the concrete or other slurry material 46. To this end, the cylinder blocks 16*a*, 16*b* of the respective drive cylinders 12*a*, 12*b* are coupled together by a bracket plate 102 receiving some of the tie rods 37*a*, 37*b*. The front ends 28*a*, 28*b* of the respective piston cylinders 24*a*, 24*b* are also held to respective ones of a pair of support collars 32*a*, 32*b* so as to be accessible through apertures 41*a* and 41*b* to open into hopper 136 via rear wall 134 thereof.

The distal ends 74*a*, 74*b* of the hose sections 70*a*, 70*b* may be provided with a cap and/or reservoir as above-described so that hose sections 70*a*, 70*b* are independent, or they may advantageously be fluidically coupled together as will now be described. To that end, a further fitting 150 such as a cylindrical 1 ½' length of plastic connecting pipe has its formed ends 152, 154 received into the distal ends 74*a*, 74*b* of hose sections 70*a*, 70*b*. Hose clamps 156, 158 may be used to clamp each end 152, 154 to respective hose sections 70*a*, 70*b*. As a result, an essentially continuous hose 170, is created that couples fluid 60 to the drive rods 14*a*, 14*b* and cylinders 24*a*, 24*b* as the respective pistons 20*a*, 20*b* reciprocate. Typically, the pistons 20*a*, 20*b* are caused to reciprocate in opposite directions so that as piston 20*a*, for example, is on the back stroke, the other piston 20*b* is in the front stroke, or vice versa. The swing tube 42 may be moved back and forth by plate 172 rotated back and forth about axle 174 so as to selectively couple its inlet end 44 to the piston pump 10*b*, for example, which is in the forward stoke, to pump concrete out from the front end 28*b*, while front end 28*a* of the other pump 10*a* is open into hopper 136 to thereby pump concrete 46 into the piston cylinder 24*a* thereof. Also, when pistons 20*a*, 20*b* move in opposite directions, fluid 60 in hose sections 70*a*, 70*b* may be pushed back and forth between cylinders 24*a*, 24*b* to thus provide even greater cleaning or lubricating action or capacity.

To provide fluid 60 into hose sections 70*a*, 70*b* or to remove fluid 60 (and debris 47 from material 46) therefrom, one of clamps 156 or 158 may be removed to allow the associated end 152 or 154 to be pulled out from the distal end 74*a*, 74*b* of a hose section 70*a* or 70*b*, which may then be placed in the up (U) or down (D) position as previously described for filling or emptying of hose 70 in FIG. 1. Alternatively, if fitting 150 is a T-connector (not shown), the tee portion thereof may have a threadably removable cap for access to hose 170 without releasing clamps 156, 158.

As can be seen from the above, the drive rod 14 and interior surface 54 of the piston cylinder 24 are cleaned and/or lubricated without the need for a water box (not shown) and its attendant drawbacks. The drive rod 14 may thus be made short enough simply to handle the length of the stroke of the piston cylinder 24 without also taking into account the added length of a water box thereby shortening the overall length of the slurry piston pump 10. Moreover, the drive cylinder 12 and piston cylinder 24 may be directly coupled together such that the parts joining them together are accessible exteriorally thereof and without reaching into a water box which may be unduly confining and difficult to manipulate. Further, the fluid hose 70 may be sealed from the environment so that it does not have a tendency to slosh fluid and/or debris either in use or during transportation of the slurry piston pump 10 thereby eliminating the spill hazards thereof. Still further, the hose 70 may be readily accessed for filling and/or emptying without being unduly limited in access thereto.

By virtue of the foregoing, it is thus seen that there is provided a slurry piston pump which eliminates the water box and its attendant drawbacks.

While the present invention has been illustrated by the description of various embodiments thereof, and while the embodiments have been described in considerable detail, it is not intended to restrict or in any way limit the scope of the appended claims to such detail. Additional advantages and modifications will readily appear to those skilled in the art.

For example, hose 70 could be made up of rigid steel tubing instead of flexible material. Also, hose 70 may be more permanently joined to the wall 56 of piston cylinder 24 than the releasable connection provided by clamp 72 as shown herein. The hose 70 may also extend out and away from cylinder 24 or may be looped around in any desired fashion, such as may be dictated by the cramped quarters in which the pump 10 is to be placed. Also, fluid 60 is exposed to the drive rod 14 and the interior 23 of cylinder 24 behind piston 20. Advantageously, piston 20 has a relatively close fit within cylinder 24. It will be appreciated that the fit will not be very tight, however, such that some fluid 60 may seep past piston 20 to flow ahead of the piston 20. The invention in its broader aspects is therefore not limited to specific details, representative apparatus, and methods and illustrative examples shown and described. Accordingly, departures may be made from such details without departing from the scope or spirit of applicant's general inventive concept.

Having described the invention, what is claimed is:

1. A water box-free piston pump for a slurry material comprising:

a reciprocating drive rod having an end;

a piston supported at an end of the drive rod;

a piston cylinder having a sidewall defining an interior extending between a back end and a front end, the piston being mounted in the interior of the piston cylinder so as to be movable between the back and front ends thereof whereby to pump slurry material into and out of the front end of the piston cylinder in response to reciprocation of the drive rod; and a fluid cleaning system consisting essentially of a fluid hose having a cylinder end and a distal end, the cylinder end of the fluid hose being fluidically coupled into the back end of the piston cylinder whereby to expose fluid in the fluid hose to the drive rod and the interior of the piston cylinder at the back end thereof.

2. A water box-free dual piston pump for a slurry material comprising:

first and second reciprocating drive rods each having an end;

first and second pistons supported at the respective ends of the first and second drive rods;

first and second piston cylinders each having a sidewall defining an interior extending between a back end and a front end, the first and second pistons being mounted respectively in the interior of the first and second piston cylinders so as to be movable between the back and front ends of the respective piston cylinders whereby to pump slurry material into and out of the front ends of the piston cylinders in response to reciprocation of the respective drive rods; and a fluid cleaning system consisting essentially of a fluid hose having opposite ends being coupled to the back end of the first piston cylinder and the back end of the second piston cylinder, respectively, whereby to expose fluid in the fluid hose to the interiors of the piston cylinders at the back ends thereof.

3. The pump of claim 2, each piston cylinder including a fluid fitting rotatably mounted on the sidewall thereof adjacent the back end, the fluid hose ends being coupled to the piston cylinders via the fluid fittings.

4. The pump of claim 2, the fluid hose including first and second hose sections, each section having a cylinder end and a distal end, the cylinder end of each hose section being coupled to the back end of a respective piston cylinder, the distal ends of the hose sections being selectively coupled together.

5. A water box-free piston pump for a slurry material comprising:

a reciprocating drive rod having an end;

a piston supported at an end of the drive rod;

a piston cylinder having a sidewall defining an interior extending between a back end and a front end, the piston being mounted in the interior of the piston cylinder so as to be movable between the back and front ends thereof whereby to pump slurry material into and out of the front end of the piston cylinder in response to reciprocation of the drive rod; and a fluid hose having a cylinder end and a distal end, the cylinder end of the fluid hose being fluidically coupled into the back end of the piston cylinder whereby to expose fluid in the fluid hose to the drive rod and the interior of the piston cylinder at the back end thereof, the fluid hose being sized to contain, in cooperation with the piston cylinder interior, substantially all fluid intended to be exposed to the interior of the piston cylinder.

6. The pump of claim 5, further comprising a removable cap closing the distal end of the fluid hose.

7. A water box-free dual piston pump for a slurry material comprising:

first and second reciprocating drive rods each having an end;

first and second pistons supported at the respective ends of the first and second drive rods;

first and second piston cylinders each having a sidewall defining an interior extending between a back end and a front end, the first and second pistons being mounted respectively in the interior of the first and second piston cylinders so as to be movable between the back and front ends of the respective piston cylinders whereby to pump slurry material into and out of the front ends of the piston cylinders in response to reciprocation of the respective drive rods;

a fluid hose fluidically coupling the back end of the first piston cylinder to the back end of the second piston cylinder whereby to expose fluid in the fluid hose to the interiors of the piston cylinders at the back ends thereof, the fluid hose being sized to contain, in cooperation with the piston cylinder interiors, substantially all fluid intended to be exposed to the interiors of the piston cylinders.

8. A water box-free dual piston pump for a slurry material comprising:

first and second reciprocating drive rods each having an end;

first and second pistons supported at the respective ends of the first and second drive rods;

first and second piston cylinders each having a sidewall defining an interior extending between a back end and a front end, the first and second pistons being mounted respectively in the interior of the first and second piston cylinders so as to be movable between the back and front ends of the respective piston cylinders whereby to pump slurry material into and out of the front ends of the piston cylinders in response to reciprocation of the respective drive rods; and a flexible fluid hose spanning substantially completely between the respective back ends of the first and second piston cylinders and fluidically coupling the back end of the first piston cylinder to the back end of the second piston cylinder whereby to expose fluid in the fluid hose to the interiors of the piston cylinders at the back ends thereof, each piston cylinder including a fluid fitting rotatably mounted on the sidewall thereof adjacent the back end, the fluid hose coupled to the piston cylinders via the fluid fittings.

9. The pump of claim 8, the fluid hose including first and second hose sections, each section having a cylinder end and a distal end, the cylinder end of each hose section being coupled to the back end of a respective piston cylinder, the distal ends of the hose sections being selectively coupled together.

10. A water box-free dual piston pump for a slurry material comprising:

first and second reciprocating drive rods each having an end;

first and second pistons supported at the respective ends of the first and second drive rods;

first and second piston cylinders each having a sidewall defining an interior extending between a back end and a front end, the first and second pistons being mounted respectively in the interior of the first and second piston cylinders so as to be movable between the back and front ends of the respective piston cylinders whereby to pump slurry material into and out of the front ends of the piston cylinders in response to reciprocation of the respective drive rods; and a first and a second fluid hose each having a cylindrical end and a distal end, the cylinder ends being fluidically coupled into the respective back ends of the first and second piston cylinders and the distal ends being uncoupled whereby to expose fluid in the first and second fluid hoses, respectively, to the interiors of the first and second piston cylinders at the back ends thereof.

11. A water box-free dual piston pump for a slurry material comprising:

first and second reciprocating drive rods each having an end;

first and second pistons supported at the respective ends of the first and second drive rods;

first and second piston cylinders each having a sidewall defining an interior extending between a back end and a front end, the first and second pistons being mounted respectively in the interior of the first and second piston cylinders so as to be movable between the back and front ends of the respective piston cylinders whereby to pump slurry material into and out of the front ends of the piston cylinders in response to reciprocation of the respective drive rods; and a fluid hose fluidically coupling the back end of the first piston cylinder to the back end of the second piston cylinder whereby to expose fluid in the fluid hose to the interiors of the piston cylinders at the back ends thereof;

first and second fluid fittings mounted on respective sidewalls of the first and second piston cylinders adjacent the back ends thereof with the fluid hose being coupled to the piston cylinders via the fluid fittings, the fluid fittings being rotatably mounted to the piston cylinders and adapted to allow, upon rotation, the fluid hose to be oriented in an upward position elevated above the piston cylinders and a downward position below the piston cylinders.

12. The pump of claim 11, the fluid hose including first and second hose sections, each section having a cylinder end and a distal end, the cylinder end of each hose section being coupled to the back end of a respective piston cylinder, the distal ends of the hose sections being selectively coupled together.

13. The pump of claim 12 further comprising a fitting removably joining the hose section distal ends together in fluid communication.

14. The pump of claim 13, the fitting removably joining the hose section distal ends together comprising a cylindrical pipe section coupled at its respective ends to the distal ends of the hose sections.

15. The pump of claim 11 further comprising first and second drive cylinders supporting the first and second drive rods for reciprocation therein, the first and second drive cylinders being directly coupled respectively to the back ends of the first and second piston cylinders.

16. The pump of claim 15 further comprising hydraulic connectors associated with each of the drive cylinders whereby to hydraulically control reciprocation of the drive rods.

17. The pump of claim 11, the hose being comprised of flexible material.

18. A water box-free piston pump for a slurry material comprising:

a reciprocating drive rod having an end;

a piston supported at an end of the drive rod;

a piston cylinder having a sidewall defining an interior extending between a back end and a front end, the piston being mounted in the interior of the piston cylinder so as to be movable between the back and front ends thereof whereby to pump slurry material into and out of the front end of the piston cylinder in response to reciprocation of the drive rod;

a fluid hose having a cylinder end and a distal end, the cylinder end of the fluid hose being fluidically coupled into the back end of the piston cylinder whereby to expose fluid in the fluid hose to the drive rod and the interior of the piston cylinder at the back end thereof; and a removable cap selectively closing the distal end of the fluid hose.

19. The pump of claim 18, the piston cylinder including a fluid fitting on the sidewall adjacent the back end thereof, the cylinder end of the fluid hose being coupled to the piston cylinder via the fluid fitting.

20. The pump of claim 19, the fluid fitting being rotatably coupled to the piston cylinder sidewall.

21. The pump of claim 18, further comprising a drive cylinder supporting the drive rod for reciprocation therein, the drive cylinder being coupled directly to the back end of the piston cylinder.

22. The pump of claim 21 further comprising a hydraulic connector associated with the drive cylinder whereby to hydraulically control reciprocation of the drive rod.

23. The pump of claim 18, the hose being comprised of flexible material.

24. A water box-free piston pump for a slurry material comprising:

a reciprocating drive rod having an end;

a piston supported at the end of the drive rod;

a piston cylinder having a sidewall defining an interior extending between a back end and a front end, the piston being mounted in the interior of the piston cylinder so as to be movable between the back and front ends of the piston cylinder whereby to pump slurry material into and out of the front end of the piston cylinder in response to reciprocation of the drive rod; and a fluid hose having a cylinder end and a distal end, the cylinder end of the fluid hose being fluidically coupled to the back end of the piston cylinder whereby to expose fluid in the fluid hose to the drive rod and the interior of the piston cylinder at the back end thereof, the piston cylinder including a fluid fitting mounted on the sidewall thereof adjacent the back end with the fluid hose being coupled to the piston cylinder via the fluid fitting, the fluid fitting being rotatably mounted to the piston cylinder and adapted to allow, upon rotation, the fluid hose to be oriented in an upward position elevated above the piston cylinder and a downward position below the piston cylinder.

25. A method of cleaning or lubricating a slurry material dual piston pump wherein drive rods extend into an interior of respective piston cylinders through respective back ends thereof and are coupled to pistons of the respective piston cylinders, the respective pistons being movable between the back end and a front end of the cylinders by reciprocation of the respective drive rods to pump slurry material into and out of the front ends of the pump cylinders, the method comprising:

fluidically coupling a flexible fluid hose to span substantially completely between the back ends of the first and second piston cylinders;

providing a fluid in the fluid hose; and reciprocating the drive rods to move the pistons while exposing the fluid in the hose to the interiors of the piston cylinders.

26. A method of exposing drive rods of a slurry material dual piston pump to a fluid without a water box, wherein the drive rods extend into an interior of respective hydraulic pump cylinders through respective back ends thereof and are coupled to pump pistons of the respective hydraulic pump cylinders, the respective pump pistons being movable between the back end and a front end of the pump cylinders by reciprocation of the respective drive rods to pump slurry material into and out of the front ends of the pump cylinders, the method comprising:

providing respective fluid hoses each having a cylinder end and a distal end;

fluidically coupling the cylinder end of the respective hoses into the back end of the respective pump cylinders;

providing a fluid in the respective fluid hoses with the distal ends of the hoses being uncoupled; and reciprocating the drive rods to move the pistons while exposing the fluid in the respective fluid hoses to the interiors of the respective pump cylinders.

27. The method of claim 26 wherein the piston cylinders each have a sidewall defining the interiors, the method further comprising fluidically coupling the fluid hoses through the sidewalls of the pump cylinders.

28. A method of cleaning or lubricating a slurry material dual piston pump wherein drive rods extend into an interior of respective piston cylinders through respective back ends thereof and are coupled to pistons of the respective piston cylinders, the respective pistons being movable between the back end and a front end of the cylinders by reciprocation of the respective drive rods to pump slurry material into and out of the front ends of the pump cylinders, the method comprising:

providing a fluid hose sized to contain, in cooperation with the piston cylinder interiors, substantially all fluid intended to be exposed to the interiors of the piston cylinders;

fluidically coupling the fluid hose between the back ends of the first and second piston cylinders;

providing a fluid in the fluid hose; and reciprocating the drive rods to move the pistons while exposing the fluid in the hose to the interiors of the piston cylinders.

29. A method of cleaning or lubricating a slurry material dual piston pump wherein drive rods extend into an interior of respective piston cylinders through respective back ends thereof and are coupled to pistons of the respective piston cylinders, the respective pistons being movable between the back end and a front end of the cylinders by reciprocation of the respective drive rods to pump slurry material into and out of the front ends of the pump cylinders, the method comprising:

fluidically coupling a fluid hose between the back ends of the first and second piston cylinders;

providing a fluid in the fluid hose;

reciprocating the drive rods to move the pistons while exposing the fluid in the hose to the interiors of the piston cylinders; and emptying out the fluid from the fluid hose while selectively accessing the fluid hose between the back ends of the first and second piston cylinders.

30. A method of cleaning or lubricating a slurry material piston pump wherein a drive rod extends into an interior of a piston cylinder through a back end thereof and is coupled to a piston of the piston cylinder, the piston being movable between the back end and a front end of the piston cylinder by reciprocation of the drive rod to pump slurry material into and out of the front end of the piston cylinder, the method comprising:

providing a fluid hose having a cylinder end and a distal end;

fluidically coupling the cylinder end of the fluid hose into the back end of the piston cylinder;

providing a fluid in the fluid hose in an amount such that substantially all of the fluid is contained within the fluid hose and the interior of the piston cylinder; and reciprocating the drive rod to move the piston while exposing the fluid in the hose to the interior of the piston cylinder.

31. The method of claim 30 wherein the piston cylinder has a sidewall defining the interior, the method further comprising fluidically coupling the fluid hose through the sidewall of the piston cylinder.

32. The method of claim 30 further comprising providing a cap on the distal end of the fluid hose.

33. The method of claim 32 further comprising removing the cap from the distal end and providing the fluid in the fluid hose through the distal end thereof.

34. The method of claim 32 further comprising removing the cap from the distal end and draining the fluid from the fluid hose through the distal end thereof.

35. The method of claim 30 further comprising providing fluid in the fluid hose through the distal end thereof.

36. A method of exposing drive rods of a slurry material dual piston pump to a fluid without a water box, wherein the drive rods extend into an interior of respective hydraulic pump cylinders through respective back ends thereof and are coupled to pump pistons of the respective hydraulic pump cylinders, the respective pump pistons being movable between the back end and a front end of the pump cylinders by reciprocation of the respective drive rods to pump slurry material into and out of the front ends of the pump cylinders, the method comprising:

providing respective fluid hoses each having a cylinder end and a distal end and sized collectively to contain, in cooperation with the piston cylinder interiors, substantially all fluid intended to be exposed to the piston cylinder interiors;

fluidically coupling the cylinder end of the respective hoses into the back end of the respective piston cylinders;

providing a fluid in the respective fluid hoses; and reciprocating the drive rods to move the pistons while exposing the fluid in the respective fluid hoses to the interiors of the respective piston cylinders.

37. A method of cleaning or lubricating a slurry material piston pump wherein a drive rod extends into an interior of a piston cylinder through a back end thereof and is coupled to a piston of the piston cylinder, the piston being movable between the back end and a front end of the piston cylinder by reciprocation of the drive rod to pump slurry material into and out of the front end of the piston cylinder, the method comprising:

providing a fluid hose having a cylinder end and a distal end;

fluidically coupling the cylinder end of the fluid hose into the back end of the piston cylinder;

providing a fluid in the fluid hose;

providing a cap on the distal end of the fluid hose; and reciprocating the drive rod to move the piston while exposing the fluid in the hose to the interior of the piston cylinder.

38. A method of cleaning or lubricating a slurry material dual piston pump wherein drive rods extend into an interior of respective piston cylinders through respective back ends thereof and are coupled to pistons of the respective piston cylinders, the respective pistons being movable between the back end and a front end of the cylinders by reciprocation of the respective drive rods to pump slurry material into and out of the front ends of the piston cylinders, the method comprising:

fluidically coupling a fluid hose between the back ends of the first and second piston cylinders;

providing a fluid in the fluid hose in an amount such that substantially all of the fluid is contained within the fluid hose and the interiors of the piston cylinders; and reciprocating the drive rods to move the pistons while exposing the fluid in the hose to the interiors of the piston cylinders.

39. The method of claim 38 wherein the piston cylinders each have a sidewall defining the interior, the method further comprising fluidically coupling the fluid hose through the sidewalls of the piston cylinders.

40. The method of claim 38 further comprising selectively accessing the fluid hose between the back ends of the first and second piston cylinders.

41. The method of claim 40 further comprising providing the fluid in the fluid hose while accessing the fluid hose between the back ends of the first and second piston cylinders.

42. The method of claim 40 further comprising emptying out the fluid from the fluid hose while accessing the fluid hose between the back ends of the first and second piston cylinders.

43. The method of claim 38 further comprising reciprocating the drive rods so as to move the pistons in unison but in opposite directions.

* * * * *